US006655048B2

(12) United States Patent
Moretti

(10) Patent No.: US 6,655,048 B2
(45) Date of Patent: Dec. 2, 2003

(54) BREATHABLE AND WATERPROOF SOLE FOR SHOES

(75) Inventor: Mario Polegato Moretti, Crocetta del Montello (IT)

(73) Assignee: Geox S.p.A., Montebelluna (IT)

( * ) Notice: Subject to any disclaimer, the term of this patent is extended or adjusted under 35 U.S.C. 154(b) by 0 days.

(21) Appl. No.: 09/978,634

(22) Filed: Oct. 18, 2001

(65) Prior Publication Data

US 2002/0050075 A1 May 2, 2002

(30) Foreign Application Priority Data

Oct. 31, 2000 (IT) ..... PD2000A0253

(51) Int. Cl.[7] ..... A43B 7/06; A43B 7/08; A43B 7/12; A43B 13/20

(52) U.S. Cl. ..... 36/3 R; 36/3 B; 36/29; 36/98

(58) Field of Search ..... 36/3 R, 3 A, 3 B, 36/8.1, 11.5, 28, 29, 98, 103, 14

(56) References Cited

U.S. PATENT DOCUMENTS

| | | | | | |
|---|---|---|---|---|---|
| 616,112 | A | * | 12/1898 | Kennedy | 36/3 R |
| 2,016,522 | A | * | 10/1935 | Stein | 36/3 R |
| 3,012,342 | A | * | 12/1961 | Ramirez | 36/3 B |
| 3,273,265 | A | * | 9/1966 | Reinert et al. | 36/3 R |
| 4,798,009 | A | * | 1/1989 | Colonel et al. | 36/28 |
| 5,044,096 | A | * | 9/1991 | Polegato | 36/3 R |
| 5,086,572 | A | * | 2/1992 | Lee | 36/3 R |
| 5,220,791 | A | * | 6/1993 | Bulzomi | 36/3 R |
| 5,979,076 | A | * | 11/1999 | Li | 36/3 B |
| 5,983,524 | A | * | 11/1999 | Polegato | 36/3 R |
| 6,389,711 | B1 | * | 5/2002 | Polegato | 36/3 R |

FOREIGN PATENT DOCUMENTS

| | | | | |
|---|---|---|---|---|
| DE | 299 23 235 | | 7/2000 | |
| EP | 350103 | A2 * | 1/1990 | A43B/7/06 |
| EP | 0 479 183 | | 4/1992 | |
| EP | 0 960 579 | | 12/1999 | |
| GB | 2245145 | A * | 1/1992 | A43B/7/06 |
| WO | WO 97/32497 | | 9/1997 | |
| WO | WO 98/51177 | | 11/1998 | |
| WO | WO 99/26504 | | 6/1999 | |

* cited by examiner

*Primary Examiner*—Anthony D. Stashick
(74) *Attorney, Agent, or Firm*—Oblon, Spivak, McClelland, Maier & Neustadt, P.C.

(57) ABSTRACT

A breathable and waterproof sole for shoes, which comprises, at least along part of its extension, a lower waterproof component, which constitutes the tread; an upper component, with a supporting structure which has chambers which are connected to openings at least on the upper and edge surfaces; a membrane which is impermeable to water and vapor-permeable and externally surrounds at least the outward-facing regions of the upper component. The lower and upper components and the membrane are joined so as to form a seal at least in the regions where water infiltration is possible.

25 Claims, 3 Drawing Sheets

BREATHABLE AND WATERPROOF SOLE FOR SHOES

BACKGROUND OF THE INVENTION

The present invention relates to a breathable and waterproof sole for shoes.

Shoes having rubber soles which can ensure particular practicality and comfort but do not allow the foot to breathe at all are already known and commercially available.

Rubber soles with perforations in the tread and membranes superimposed on the perforated area and sealed in the peripheral regions have also been known for a few years.

These soles allow correct breathing in addition to an effective exchange of heat and water vapor between the environment inside the shoe and the outside environment while ensuring the necessary impermeableness to external moisture and water.

Other constructive solutions provide box-like rubber soles with perforations at the lateral edges which are internally obstructed by waterproof and breathable membranes which in this case also are joined peripherally so as to form a seal.

These perforated soles, provided with waterproof and breathable membranes, have certainly constituted considerable improvements with respect to what was previously available.

Nonetheless, there are still some practical drawbacks mainly due to the area occupied by the perforations, which though being sufficient has not yet reached its optimum extension.

On the other hand, in the first case the number of perforations formed in the tread and the diameter of said perforations must be kept small in order to prevent pointed foreign matter entering through the perforations from penetrating until they damage or pierce the membrane.

Such membrane is in fact continuously subjected to the compressive action of the foot, so that even a body which is not particularly sharp might easily cause damage.

Soles are also known which internally comprise channels and systems for pumping air from the inside of the shoe to the outside by means of one-way valves.

Pumping is actuated by the compression of the foot during walking.

Accordingly, in this case the operation is merely mechanical and a stream of inflowing cold air is produced which in winter periods can be particularly unpleasant, since it causes rapid chilling of the feet, causing discomfort to the user.

Moreover, the execution of the pumping devices integrated in the soles is expensive and complicated.

SUMMARY OF THE INVENTION

The aim of the present invention is to provide a breathable and waterproof sole for shoes which allows an optimum exchange of heat and water vapor with the outside, which ensures at all times an optimum internal microclimate as a function of the external microclimate, solving the above-mentioned drawbacks suffered by known types.

Within this aim, an object of the present invention is to provide a sole in which the integrity of the breathable membrane is protected effectively while allowing adequate air circulation.

Another object is to provide a sole which is able to keep the inside of the shoe dry even in the presence of condensation of the water vapor produced by perspiration due to excessive external humidity.

Another object is to provide a sole which minimizes the problem of deposition of dirty material on the breathable membrane.

Another object is to provide a sole which can be easily adapted to shoes of various kinds both for daily and sports use.

Another object is to provide a sole whose cost is comparable to the costs of known soles.

Another object is to provide a sole which can be manufactured with technologies and equipment which are already known in the field.

This aim and these and other objects which will become better apparent hereinafter are achieved by a breathable and waterproof sole for shoes, characterized in that it comprises, at least along part of its extension:

- a lower waterproof component, which constitutes the tread;
- an upper component, with a supporting structure which has interconnected chambers with outlets at least on the upper and edge surfaces;
- a membrane which is impermeable to water and vapor-permeable and externally surrounds at least the outward-facing regions of said upper component;
- said lower and upper components and said membrane being joined so as to form a seal at least in the regions where water infiltration is possible.

BRIEF DESCRIPTION OF THE DRAWINGS

Further characteristics and advantages of the invention will become better apparent from the detailed description of some embodiments thereof, illustrated only by way of non-limitative example in the accompanying drawings, wherein.

DESCRIPTION OF THE PREFERRED EMBODIMENTS

Figure 1:
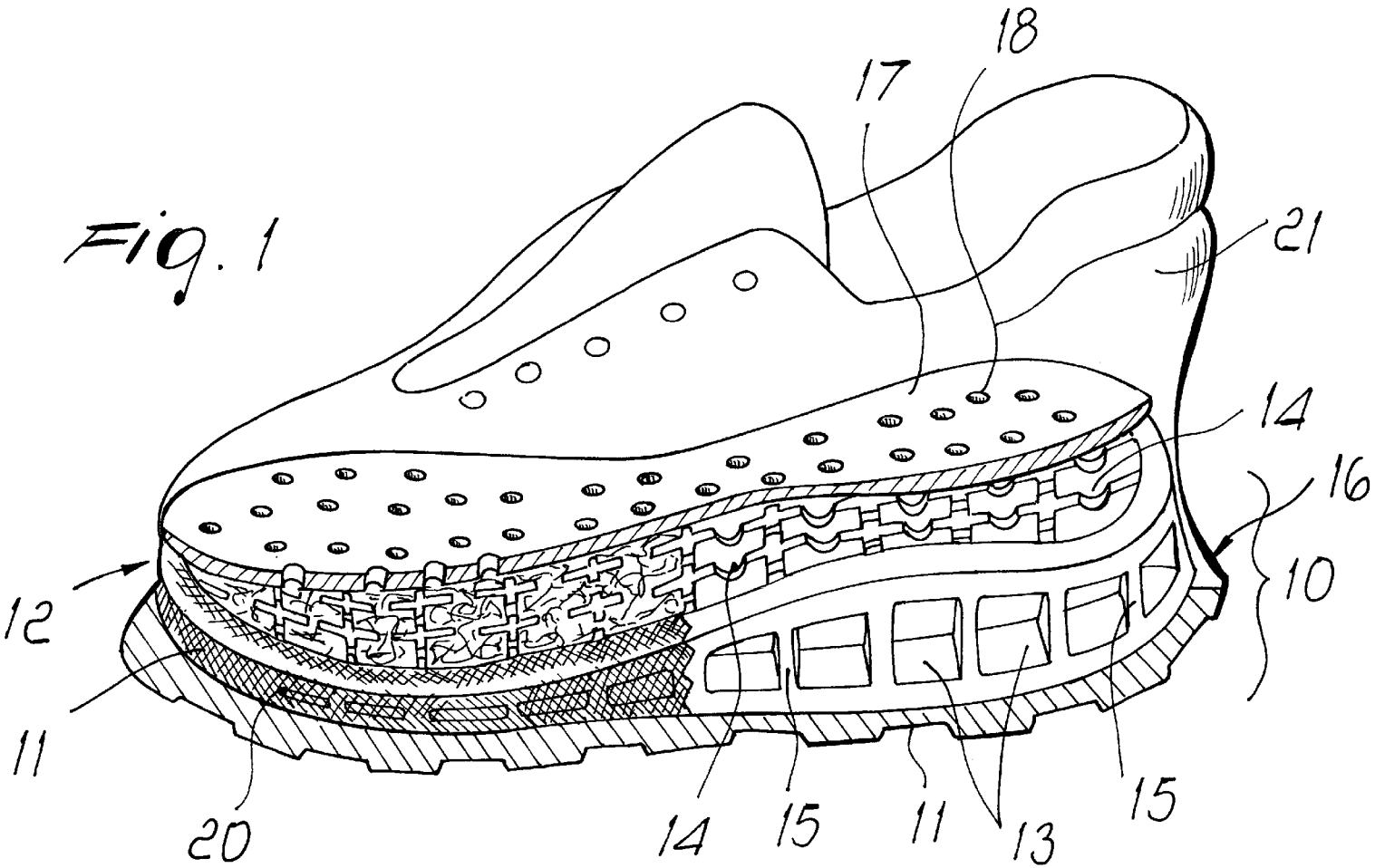
FIG. 1 is a partially sectional view, in phantom lines, of a shoe provided with a sole according to the invention.
Figure 2:
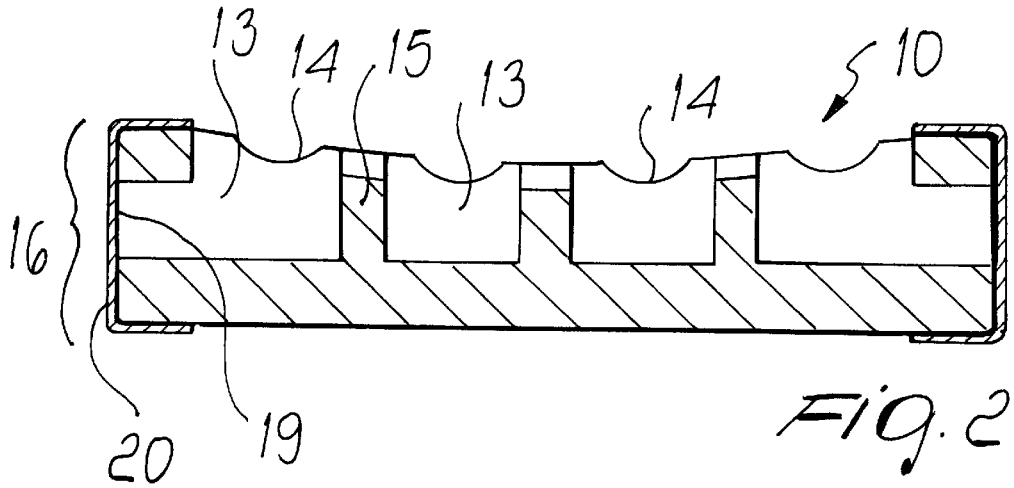
FIG. 2 is a cross-sectional view, taken along a transverse plane, of the sole of the shoe of FIG. 1.
Figure 3:
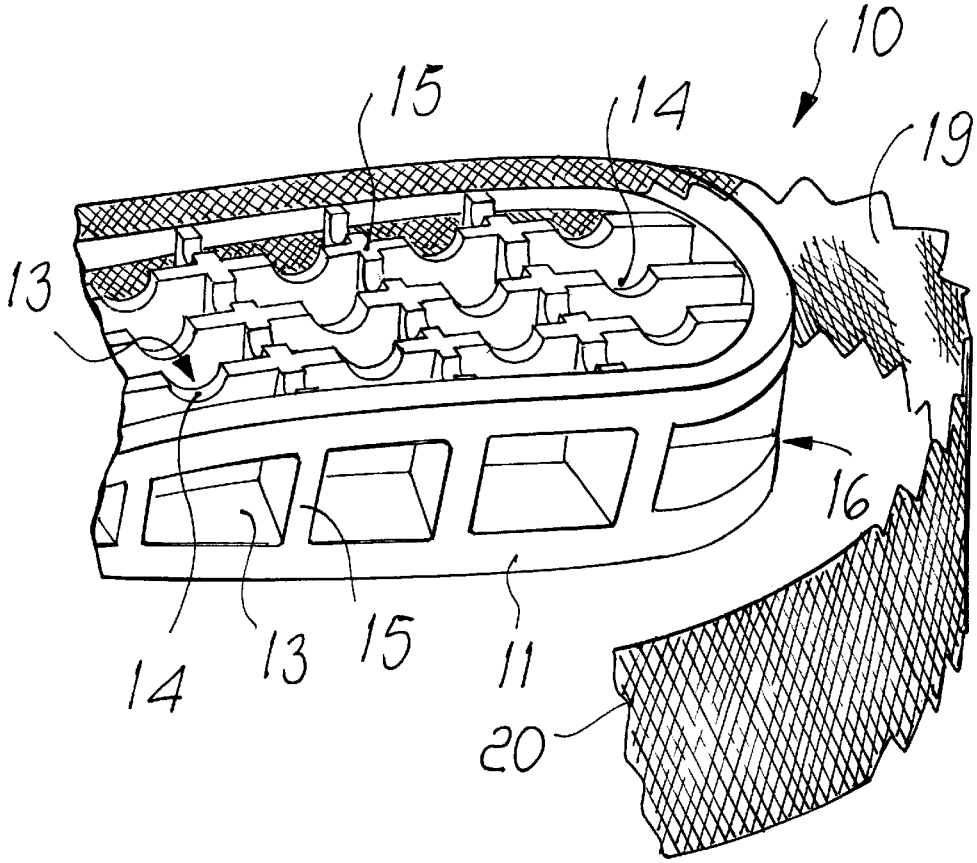
FIG. 3 is a partially exploded enlarged-scale perspective view of a detail of the sole of FIG. 2.

With reference to FIGS. 1 to 3, a breathable and waterproof sole for shoes according to the invention is generally designated by the reference numeral 10 and comprises a lower component 11, which constitutes the wear tread, in this case made of waterproof material, for example a polymer such as polyurethane, rubber, PVC or the like.

As an alternative, it is possible to use breathable materials, such as leather, waterproofed for example by means of an upper membrane which is joined perimetrically so as to form a seal, of the type which is impermeable to water and vapor-permeable.

The sole 10 further comprises an upper component 12 with a supporting structure, which has interconnected chambers with outlets at least on the upper and edge surfaces.

In the particular embodiment shown in the figures, the upper component 12 has a lattice-like structure made of plastics by molding, with chambers 13 which are interconnected by means of openings 14 provided in the partitions 15.

As shown in FIG. 1, a plurality of chambers 13 faces the lateral edge 16 and the upper supporting surface, on which in this case there is an insole 17 with through holes 18.

The insole 17 can be conveniently made of leather or other suitable breathable or perforated material.

As an alternative to what has been described, the upper component 12 can be formed for example by means of a block made of sponge-like open-cell material which is capable of bearing the weight of the user and of allowing the free passage of perspiration.

For this purpose it is possible to provide materials such as latex foams or polyurethane foams of the open-cell type.

It can also be convenient to integrate in the upper component 12 conventional impact cushioning systems, for example pads filled with air, gel, etcetera.

The sole 10 further comprises a membrane 19 made of a material which is impermeable to water and permeable to vapor (such as the ones commercially available and commonly known by the trade-name Gore-Tex).

The membrane 19, which can also be coupled to a light supporting fabric, not shown in the figures, wraps around the edge 16 of the upper component 12 at least in the regions that face outward and is joined thereto by perimetric gluing, taking care not to obstruct the chambers 13 with the adhesive.

It is therefore possible to apply adhesive to the edges of the partitions 15 or to provide the membrane 19 with such an extension that it can be turned over, as shown in FIG. 2, around the edge 16 and thus be glued in an upward region and in a downward region on the perimetric parts of the upper component 12.

The two ends of the membrane 19 can be mutually joined at one of the partitions 15 (as shown in FIG. 1) and then glued thereto so as to form a seal, or can be applied as a tape with heat or adhesives so as to provide a waterproof sealing joint.

The sole 10 further comprises, in this case, a protective element 20 superimposed on the membrane 19 and constituted for example by a fine-mesh net or by a layer of breathable material which protects the membrane 19 from contacts with blunt objects which can rupture it.

The protective element 20 can be applied by spot gluing or by full gluing in the regions of the membrane that are folded back around the edge 16, so that on the edge 16 there is no adhesive which compromises breathability.

As an alternative, the membrane 19, optionally with its protective element 20, can be arranged as a mold insert onto which the upper component 12 is overmolded so as to ultimately constitute a sealed monolithic element.

It should also be noted that the membrane can be provided so as to make it difficult to pierce, for example by using aramid fibers or other material as a support.

The membrane can be made of hydrophilic polymer, and in this case can be integrated in a support which is permeable to water and comprises fibers of materials, which are technologically per se known, as composites.

In this case, i.e., if the membrane 19 is capable of withstanding blunt objects thanks to its very structure, the presence of the protective element 20 might not be necessary.

The upper component 12 is joined hermetically to the lower component 11 according to known gluing methods, or the complete sole 10 can be manufactured by means of individual or multiple injections and by inserting, as an insert, the membrane 19 (optionally with its protective element 20) or the membrane 19 with the already-prepared upper component 12.

It is particularly important to provide a hermetic joint between all the elements in contact in the regions where water infiltration is possible.

The upper component 12 acts as a container which is closed at the bottom by the lower component 11 and is open perimetrically with a breathable and waterproof band.

The assembly is conveniently assembled to an upper 21 in manners known in the shoemaking field, taking care not to obstruct the passage of vapor from the inside of the shoe toward the chambers 13.

Figure 4:
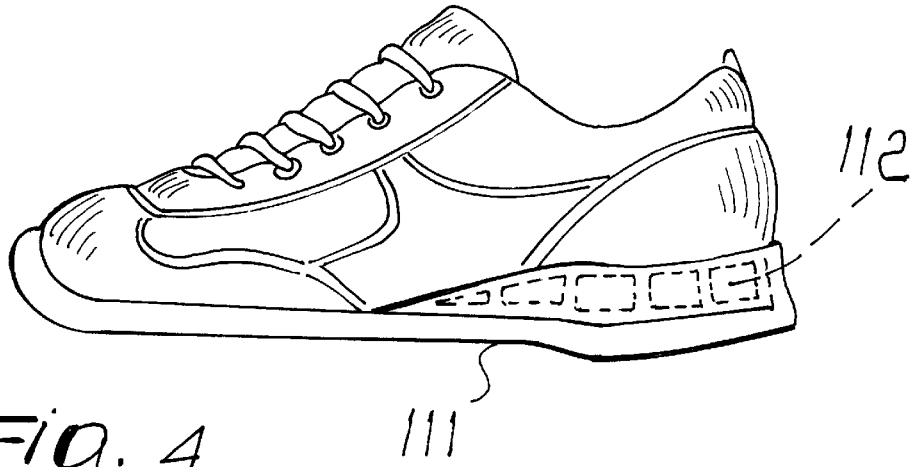
FIGS. 4 to 6 are views of shoes provided with respective embodiments of the sole according to the invention.
Figure 5:
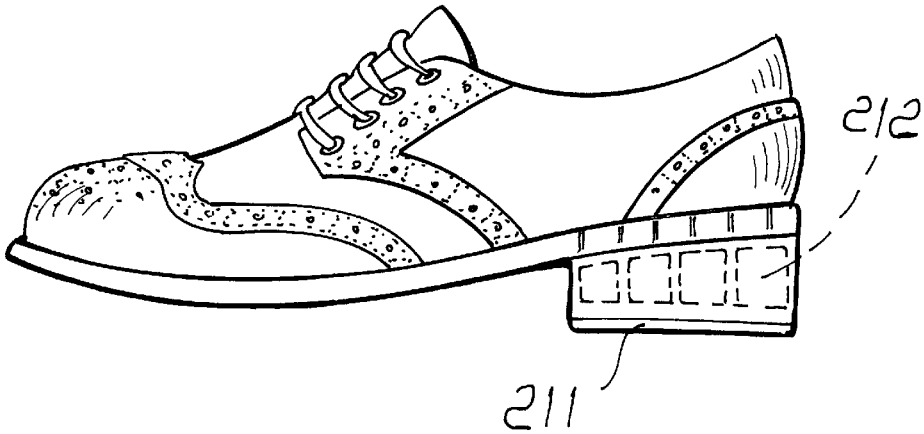
Figure 6:
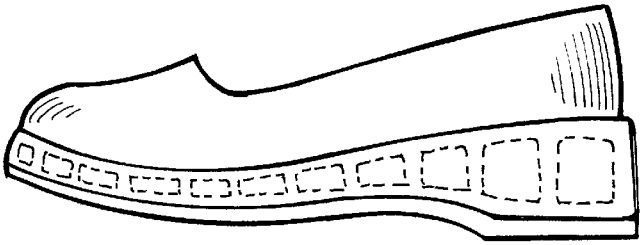

With reference now to FIGS. 4 to 6, said figures show respective embodiments of the invention, in the first of which the upper component 112 has a smaller extension than the lower component 111 and is extended in particular at the heel region.

In this case, appropriately provided channels, not shown in the figure, can be provided in an upward region in the lower component at the forefoot and it is possible to provide holes in the inner sole so that perspiration can pass easily from toe to heel.

In FIG. 5, the lower component 211 and the upper component 212 are monolithic so as to form the heel.

The sole 10 thus provided is fully impermeable and breathable along the entire edge region of the upper component 12 without thereby reducing the functionality of said sole (impact absorption, flexibility, light weight, et cetera).

From the point of view of operation, the foot compresses the upper component 12, pushing perspiration out of the shoe after the moist air has entered the upper component 12 from the holes of the insole 17.

By using a breathable and waterproof membrane of the type that also allows air to exit from inside, a considerable increase in the exchange of air in said shoe is achieved, which is very useful in products for athletes.

The invention thus conceived is susceptible of numerous modifications and variations, all of which are within the scope of the appended claims.

All the details may further be replaced with other technically equivalent elements.

Thus, for example, the lower component 11 can be conveniently constituted by a perforated lower layer with, in an upward region, a membrane which is breathable and waterproof (with or without a light supporting fabric), joined hermetically thereto in the perimetric regions.

The membrane can be conveniently provided in a downward region with a protective layer.

This occurs if it is necessary to further increase the possibility of exchange with the outside.

In practice, the materials used, so long as they are compatible with the contingent use, as well as the dimensions, may be any according to requirements.

The disclosures in Italian Patent Application No. PD2000A000253 from which this application claims priority are incorporated herein by reference.

What is claimed is:

1. A breathable and waterproof sole for shoes, comprising:

a lower waterproof component, which constitutes a tread;

an upper component, including a supporting structure having mutually interconnected chambers with openings at least on upper and edge surfaces thereof a membrane which is impermeable to water and vapor-permeable and externally surrounds said upper component at at least outward-facing regions thereof; said lower and upper components and said membrane being provided on at least part of an extension of the sole; and a seal provided at least in regions of the sole where water infiltration is possible, said seal being formed by a joining of said lower and upper components and said membrane;

wherein a plurality of said chambers face a lateral edge and an upper supporting surface of the sole.

2. The sole of claim 1, wherein said lower component that constitutes said tread is made of a polymer selected from a group comprising polyurethane, rubber, PVC and other polymers with similar properties.

3. The sole of claim 1, wherein said lower component that constitutes the tread is made of breathable materials selected from a group comprising leather, rendered waterproof by way of an upper membrane, joined perimetrically so as to form a seal, said membrane being of a type which is impermeable to water and vapor-permeable.

4. The sole of claim 1, wherein said lower component that constitutes the tread is constituted by a perforated lower layer and an upper membrane which is impermeable to water and permeable to vapor arranged on top of said lower perforated layer and joined thereto so as to form a seal around perimetric regions of said tread.

5. The sole of claim 1, wherein said upper component comprises impact cushioning systems, being any of pads filled with air, gel, and other suitable resilient materials, integrated therein.

6. The sole of claim 1, wherein said membrane includes any of aramid fibers and equivalent material resistant to piercieng, provided as a support.

7. The sole of claim 1, wherein said membrane is made of hydrophilic polymer integrated in a support which is permeable to water and comprises fibers of materials which are technologically known as composites.

8. The sole of claim 1, wherein said upper component is joined, so as to form a seal, to said lower component by known adhesive bonding systems.

9. The sole of claim 1, provided through any of an individual and a multiple injection-molding operation, and comprises as an insert said membrane, optionally with said protective element.

10. The sole of claim 1, provided through any of an individual and a multiple injection-molding operation, and comprises as an insert said membrane, with said upper component already prepared.

11. The sole of claim 1, wherein said upper component has a smaller extension than said lower component, said lower component comprising channels in regions free from said upper component and holes provided in an upward region thereof, so that perspiration can flow freely among various regions of the sole.

12. The sole of claim 1, comprising any of a breathable and a perforated protective element which covers at least outward facing regions of said membrane, said protective element being joined so as to form a seal to said upper and lower components and to said membrane by being interposed between two of said parts, at least in the regions where water infiltration is possible.

13. The sole of claim 12, wherein said protective element is constituted by any of a fine-mesh net and a layer of breathable material, which protects against rupture said membrane against contacts with blunt objects.

14. The sole of claim 13, wherein said protective element is applied by spot gluing.

15. The sole of claim 1, wherein said upper component has a lattice-like structure made of plastics, and comprises partitions which delimit said chambers, said chambers being interconnected by way of further openings provided in said partitions.

16. The sole of claim 15, wherein said membrane wraps around the edge surface of said upper component, at least in the regions that face outward and is joined thereto by perimetric adhesive bonding, so as to leave unobstructed said chambers.

17. The sole of claim 16, wherein said adhesive is applied to edges of said partitions.

18. The sole of claim 1, wherein said upper component is formed by a block of open-cell spongy material adapted to bear weight of a user and allowing perspiration to pass freely therethrough.

19. The sole of claim 18, wherein said spongy material is selected from a group comprising latex foam and polyurethane foam of the open-cell type.

20. The sole of claim 1, wherein said membrane is made of a material selected so as to be impermeable to water and vapor-permeable.

21. The sole of claim 20, wherein said membrane is coupled to a light supporting fabric.

22. A breathable and waterproof sole for shoes, comprising:

a lower waterproof component, comprising a tread;

an upper component, comprising a supporting structure having interconnected chambers with openings at least on upper and edge surfaces thereof;

a membrane which is impermeable to water and is vapor-permeable and externally surrounds said upper component at at least outward-facing regions thereof; said lower and upper components and said membrane being provided on at least part of an extension of the sole; and a seal provided at least in regions of the sole where water infiltration is possible, said seal being formed by a joining of said lower and upper components and said membrane;

wherein said upper component has a lattice-like structure made of one or more plastics, and comprises partitions which delimit said chambers, said chambers being interconnected by way of further openings provided in said partitions;

wherein said membrane wraps around the edge surface of said upper component, at least in the regions that face outward and is joined thereto by parametric adhesive bonding, to leave said chambers unobstructed;

and wherein said membrane wraps said edge surface by being folded upward and, respectively, downward, and is glued in an upward and in a downward wrapped regions to parametric parts of said upper component.

23. A breathable and waterproof sole for shoes, comprising:

a lower waterproof component, which comprises a tread;

an upper component, comprising a supporting structure having interconnected chambers with openings at least on upper and edge surfaces thereof;

a membrane which is impermeable to water and is vapor-permeable and externally surrounds said upper component at at least outward-facing regions thereof said lower and upper components and said membrane being provided on at least part of an extension of the sole; and a seal provided at least in regions of the sole where water infiltration is possible, said seal being formed by a joining of said lower and upper components and said membrane;

wherein said upper component has a lattice-like structure made of one or more plastics, and comprises partitions which delimit said chambers, said chambers being interconnected by way of further openings provided in said partitions;

wherein said membrane has ends thereof which are mutually joined at one of said partitions and are further hermetically sealed thereto, by any of glueing and tape application and heat or adhesives sealing so as to form a waterproof sealing joint.

24. A breathable and waterproof sole for shoes, comprising:

a lower waterproof component, which comprises a tread;

an upper component, comprising a supporting structure having interconnected chambers with openings at least on upper and edge surfaces thereof;

a membrane which is impermeable to water and vapor-permeable and externally surrounds said upper component at at least outward-facing regions thereof said lower and upper components and said membrane being provided on at least part of an extension of the sole;

a seal provided at least in regions of the sole where water infiltration is possible, said seal being formed by a joining of said lower and upper components and said membrane;

any of a breathable and a perforated protective element which covers at least outward facing regions of said membrane, said protective element being joined so as to form a seal to said upper and lower components and to said membrane by being interposed between two of said parts, at least in the regions where water infiltration is possible;

wherein said protective element comprises any of a fine-mesh net and a layer of breathable material, which protects said membrane against rupture; and wherein said protective element is applied by gluing the regions of the membrane that are folded around the edge surface of said upper component, so that said edge surface is free of adhesive which may compromise sole breathability.

25. A breathable and waterproof sole for shoes, comprising:

a lower waterproof component, which comprises a tread;

an upper component, comprising a supporting structure having interconnected chambers with openings at least on upper and edge surfaces thereof;

a membrane which is impermeable to water and vapor-permeable and externally surrounds said upper component at at least outward-facing regions thereof; said lower and upper components and said membrane being provided on at least part of an extension of the sole; and a seal provided at least in regions of the sole where water infiltration is possible, said seal being formed by a joining of said lower and upper components and said membrane;

any of a breathable and a perforated protective element which covers at least outward facing regions of said membrane, said protective element being joined so as to form a seal to said upper and lower components and to said membrane by being interposed between two of said parts, at least in the regions where water infiltration is possible;

wherein said membrane, optionally with said protective element, is arranged as a mold insert onto which said upper component is overmolded, to constitute a single sealed element.

* * * * *